US007300023B2

(12) United States Patent
Biagiotti

(10) Patent No.: US 7,300,023 B2
(45) Date of Patent: Nov. 27, 2007

(54) MACHINE FOR RAILWAY SWITCHING

(75) Inventor: Maurizio Biagiotti, Pisa (IT)

(73) Assignee: General Electric Company, Schenectady, NY (US)

( * ) Notice: Subject to any disclaimer, the term of this patent is extended or adjusted under 35 U.S.C. 154(b) by 153 days.

(21) Appl. No.: 10/988,853

(22) Filed: Nov. 15, 2004

(65) Prior Publication Data

US 2005/0116119 A1 Jun. 2, 2005

(30) Foreign Application Priority Data

Nov. 19, 2003 (IT) ..... FI2003A0296

(51) Int. Cl.
*E01B 7/00* (2006.01)

(52) U.S. Cl. ..... 246/449; 246/450; 246/452; 246/448

(58) Field of Classification Search ..... 246/449, 246/450, 451, 452, 453, 448, 415 R
See application file for complete search history.

(56) References Cited

U.S. PATENT DOCUMENTS

| | | | | |
|---|---|---|---|---|
| 6,056,244 | A * | 5/2000 | Durchschlag et al. | 246/257 |
| 6,164,602 | A | 12/2000 | Kuhn et al. | |
| 6,511,024 | B1 * | 1/2003 | Bonfigli | 246/415 R |
| 2002/0148932 | A1 * | 10/2002 | Biagiotti | 246/415 A |

* cited by examiner

*Primary Examiner*—Mark T. Le
(74) *Attorney, Agent, or Firm*—Gerald W. Spinks

(57) ABSTRACT

An in-tie machine for moving the movable elements of a switching device, such as the switch points of a switch point assembly or the moving V-point of a movable point frog, with a sliding device which selectively engages a control rod with either a fixed seat or a moving seat, to shift the movable elements and lock them in place.

19 Claims, 10 Drawing Sheets

MACHINE FOR RAILWAY SWITCHING

CROSS REFERENCE TO RELATED APPLICATIONS

This is application claims priority from Italian Patent Application Serial No. FI2003A000296, filed on Nov. 19, 2003, and entitled "Switch Point Machine for Railway Switching."

STATEMENT REGARDING FEDERALLY SPONSORED RESEARCH OR DEVELOPMENT

Not Applicable

BACKGROUND OF THE INVENTION

1. Field of the Invention

This invention refers to railway switching machines, and, in particular, to those devices which are used to move the rail end points of switch point assemblies. More specifically, this invention refers to a device for use either with switch point assemblies having connected rail end points, or with movable point frog assemblies.

2. Background Art

As is commonly known, railway switch point assemblies include two rail end points which are tapered rail profiles capable of deflecting to move between two different positions, in order to facilitate the correct alignment of the track components for the desired path of rolling stock transiting through the switch point assembly. The switch point assembly has two deflectable or movable rail end points which move in concert with one another between first and second alternative positions. In a first alternative position, a first one of these movable rail end points can be aligned with a first fixed stock rail to facilitate passage of the rolling stock straight through the switch point onto a first set of fixed rails. In a second alternative position, the second movable rail end point can be aligned with a second fixed stock rail to facilitate passage of the rolling stock onto a second set of fixed rails, such as to divert the rolling stock onto a siding. The remote ends of the two deflectable rails almost intersect, near the location where the second set of fixed rails diverges from the first set of fixed rails.

At the ends of the deflectable rails where they almost intersect, it is necessary to provide a means for the rims of the wheels of the rolling stock to cross the fixed rail which is not being followed, and to pass from one of the deflectable rails onto the desired set of fixed rails. Frog assemblies are used for this purpose, wherein the left rail of one set of rails beyond the frog assembly, and the right rail of the other set of rails beyond the frog assembly form a "V-point" adjacent to the point where the deflectable rails cross. At this point, the remote ends of the deflectable switch point rails can form "wing rails" on either side of the V-point.

Some of these frog assemblies can have a fixed V-point, a fixed wing rail, and a deflectable wing rail which can deflect as the wheel rims pass through, allowing the rolling stock to follow the desired set of fixed rails. These are "fixed point" frog assemblies. Still other frog assemblies can have fixed wing rails and a moving or deflectable V-point which can be aligned with either of the wing rails, according to the desired path of the rolling stock. These are commonly called "movable point" frog assemblies.

In the typical switch point assembly, the two deflectable rail end points are moved by rods protruding from the opposite extremities of a unit often called the switch point machine. Inside the switch point machine, the rods are usually connected to a device with a reciprocating straight line motion, which is powered by a motor unit which is generally placed to the side of the rails. The state of the art includes numerous switch point machines for railway split point movements. For example, EP 1,245,469 to Biagiotti describes such a switch point machine. Such mechanisms are normally installed at the switch point, and they are typically applied only to move the split rail end points of the switch point assembly.

Therefore, it is desirable to provide a simple type of mechanism which can be used either to move the deflectable rail end points of the switch point assembly or to move the deflectable V-point of a movable point frog assembly.

BRIEF SUMMARY OF THE INVENTION

The apparatus of the present invention is composed of a fixed casing, a control rod, and a power driven sliding mechanism. The casing is designed to be suitable for replacing a railroad tie beneath the rails of intersecting sections of railroad tracks and, where appropriate, beneath the moving point frog assembly between them. At least one fixed plate is joined to the casing and provided with at least one seat capable of receiving an operating pin in the control rod. The power driven sliding mechanism interacts with the operating pin and the fixed plate to selectively move the control rod in the desired direction. The control rod can be connected either to two movable rail end points for operating a switch point assembly, or to a movable V-point for operating a movable point frog assembly.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
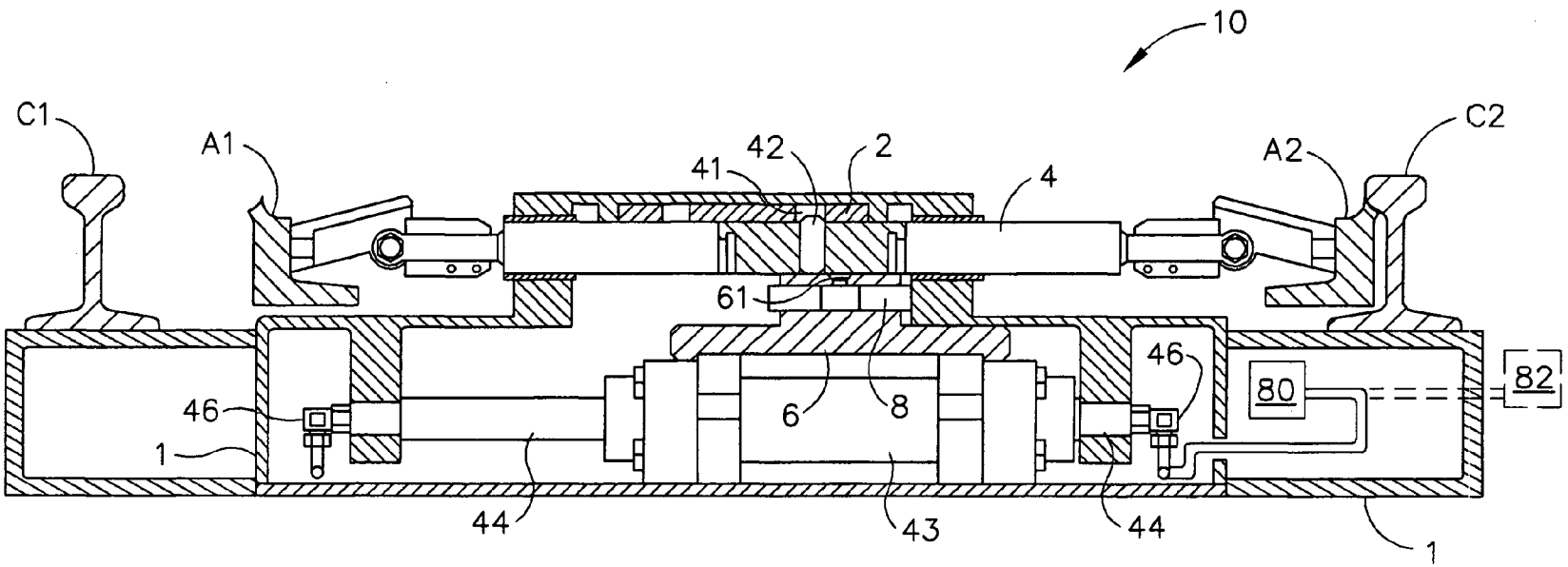
FIG. 1 is a schematic view of a first embodiment of a machine according to the present invention, having a single operating pin, for use with split point movements.
Figure 5A:
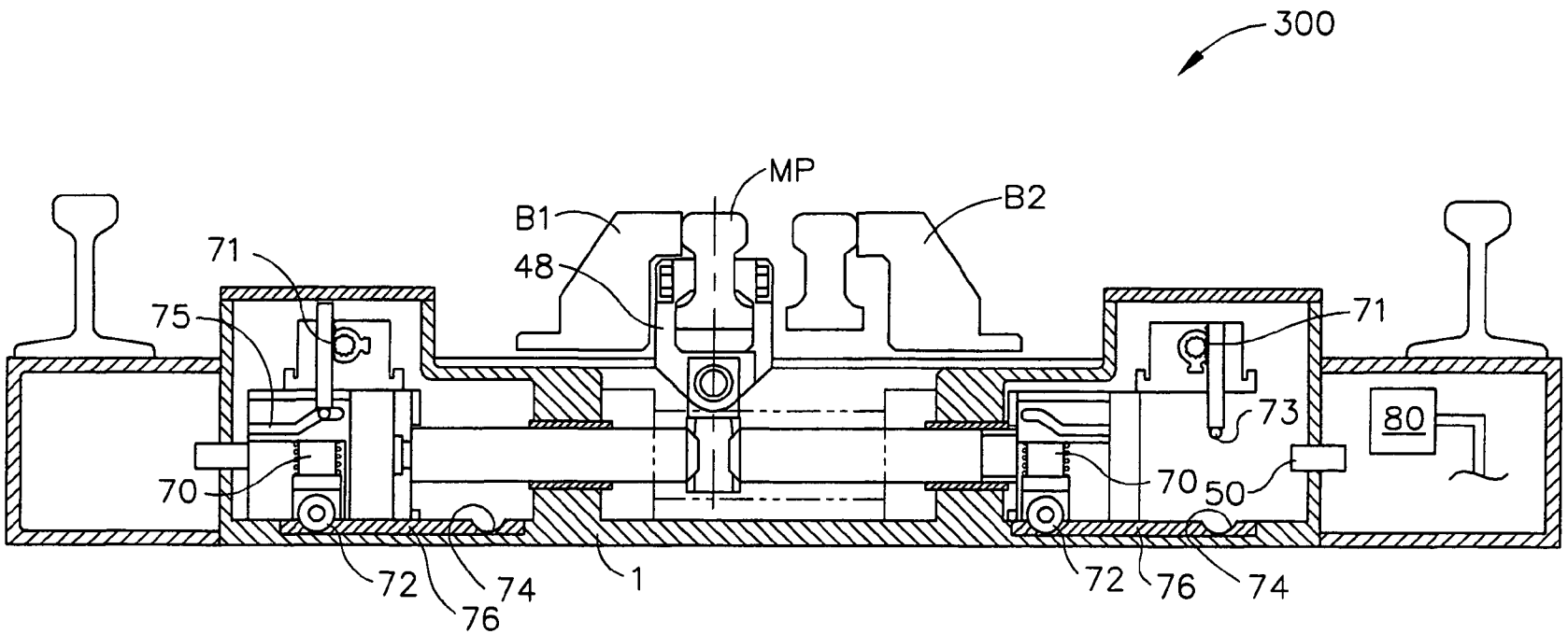
FIG. 5*a* is a vertical section of a fourth embodiment of a machine according to the present invention, for use with "movable point frogs"

The present invention provides a machine for railway switch movements for operating either split points or movable point frogs. The split points are movable switching elements of a railway switch assembly, and the movable point is the movable switching element of a movable point frog assembly. As shown in FIG. 1, a first embodiment of a machine 10 according to the present invention includes a fixed casing 1, a fixed plate 2 mounted to the casing 1, and a sliding control rod 4. The fixed casing 1 is constructed so as to function as a railroad tie, typically located beneath the rails of a railroad track for support and positioning of the rails. Requirements of such ties are known in the art. Further, the fixed casing 1 can be particularly suited to function as a railroad tie positioned beneath the rails of intersecting sections of railroad tracks, and beneath a moving point frog assembly located between the rails, as shown in FIG. 5*a*. In any embodiment, the ends of the casing 1 can extend sufficiently far to each side to allow the casing 1 to function as a railroad tie beneath any rails located on either side of the assembly. For the sake of clarity, the casing extensions are not shown in some of the FIG.

A slide 6 is mounted to the housing of a sliding mechanism 43, such as a pneumatic or hydraulic cylinder having a moving housing. The sliding mechanism 43 has two operating rods 44, such as piston rods, extending from its housing. Either an internal power unit 80 or an external power unit 82 provides the power to shift the slide 6. The power unit 80, 82 can be either a motor adapted to drive mechanical operating rods, as is known in the art, or a motor driven pump which provides fluid power, via fittings 46 in the piston rods 44, to shift the housing of the sliding mechanism 43 from one position to another. The fluid power could be either hydraulic or pneumatic.

The slide 6 contacts the lower surface of the control rod 4. An operating pin 42 is slidingly positioned in a vertical bore through the control rod 4. The operating pin 42 can have rounded ends. The fixed plate 2 has two fixed seats 41 adapted to receive the upper end of the operating pin 42. The upper surface of the slide 6 has a moving seat 61 adapted to receive the lower end of the operating pin 42. The ends of the control rod 4 are connected to the deflectable rail end points A1, A2 involved in the switch assembly, which can be moved transversely between contact with either of the two stock rails C1, C2.

The outer ends of the piston rods 44 of the sliding mechanism 43 are fixedly connected to the casing 1. Pressurization of the sliding mechanism 43 via fittings 46 moves the housing of the sliding mechanism 43 in one direction or the other, as desired, while the piston rods 44 remain fixed relative to the casing 1. Alternatively, instead of a hydraulic or pneumatic mechanism, one or more operating rods mechanically linked from the output of an external motor to the slide 6 could be used, as is known in the art. A stroke limiter 8 is connected to the slide 6, to limit the travel of the slide 6 relative to the casing 1.

Figure 4A:
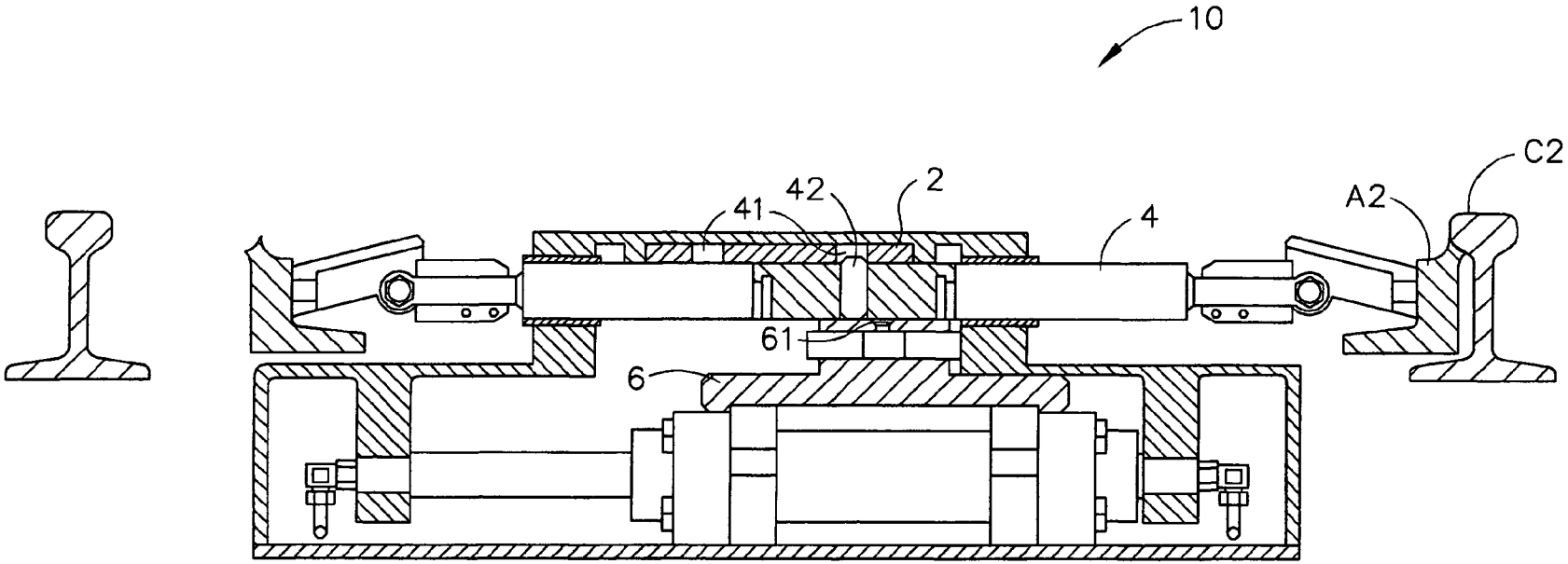
FIGS. 4*a* through 4*e* are schematic views showing the operational phases of the switch point machine shown in FIG. 1.

FIGS. 4*a* through 4*e* illustrate the different phases of operation of the machine 10 shown in FIG. 1, and the relative positions of the components of the switch point machine. In FIG. 4*a*, the rail end point A2 on the right contacts the right stock rail C2 in a first position at the right hand end of the stroke. In this position, the control rod 4 is held in position relative to the fixed plate 2 because the upper end of the operating pin 42 is engaged with the right hand fixed seat 41 in the plate 2. The operating pin 42 is held in this upper position by being forced upwardly by the slide 6, which is in its far right position. At this position, the lower end of the operating pin 42 is not in the moving seat 61 on the slide 6.

Figure 4B:
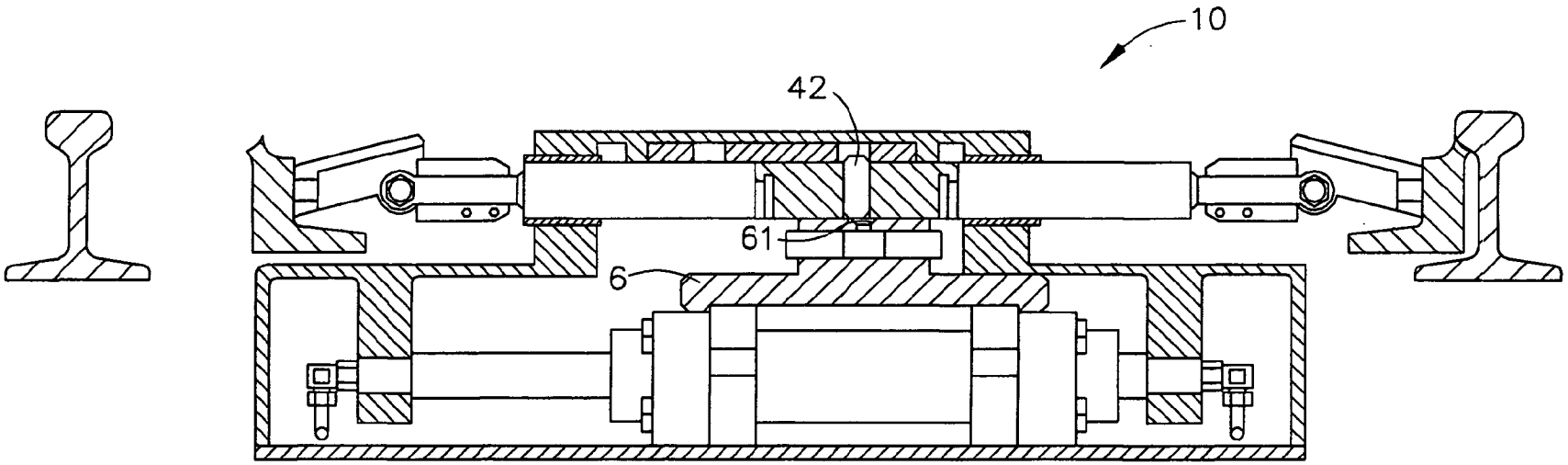

FIG. 4*b* shows the sliding mechanism 43 and the slide 6 beginning to move toward the left, under fluid pressure as discussed above. The lower end of the operating pin 42 is sliding along the upper surface of the slide 6, but it has not yet reached the moving seat 61 on the slide 6. So, the control rod 4 has not moved from its right hand position.

Figure 4C:
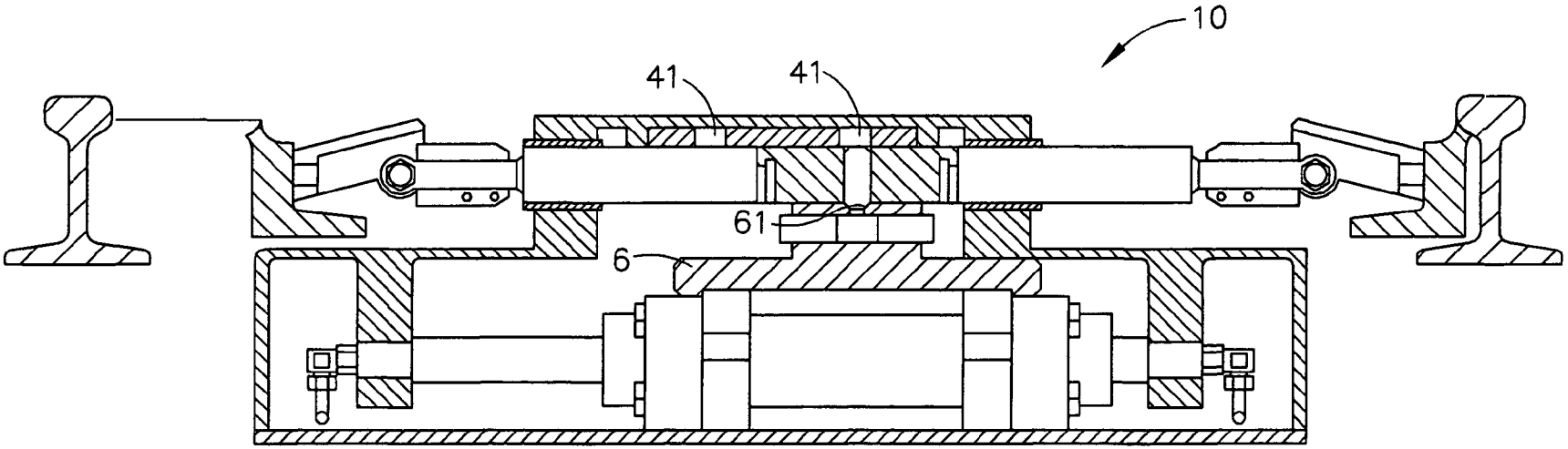

In FIG. 4*c*, the moving seat 61 on the upper surface of the slide 6 has reached the lower end of the operating pin 42. This allows the operating pin 42 to drop out of the right hand fixed seat 41 in the fixed plate 2, and into the moving seat 61 on the slide 6. This disengages the control rod 4 from the fixed plate 2, and engages the control rod 4 with the slide 6. Thereafter, further movement of the slide 6 will move the control rod 4 to the left by interaction of the slide 6, the operating pin 42, and the control rod 4, thereby moving the right rail end point A2 away from the right hand stock rail C2.

Figure 4D:
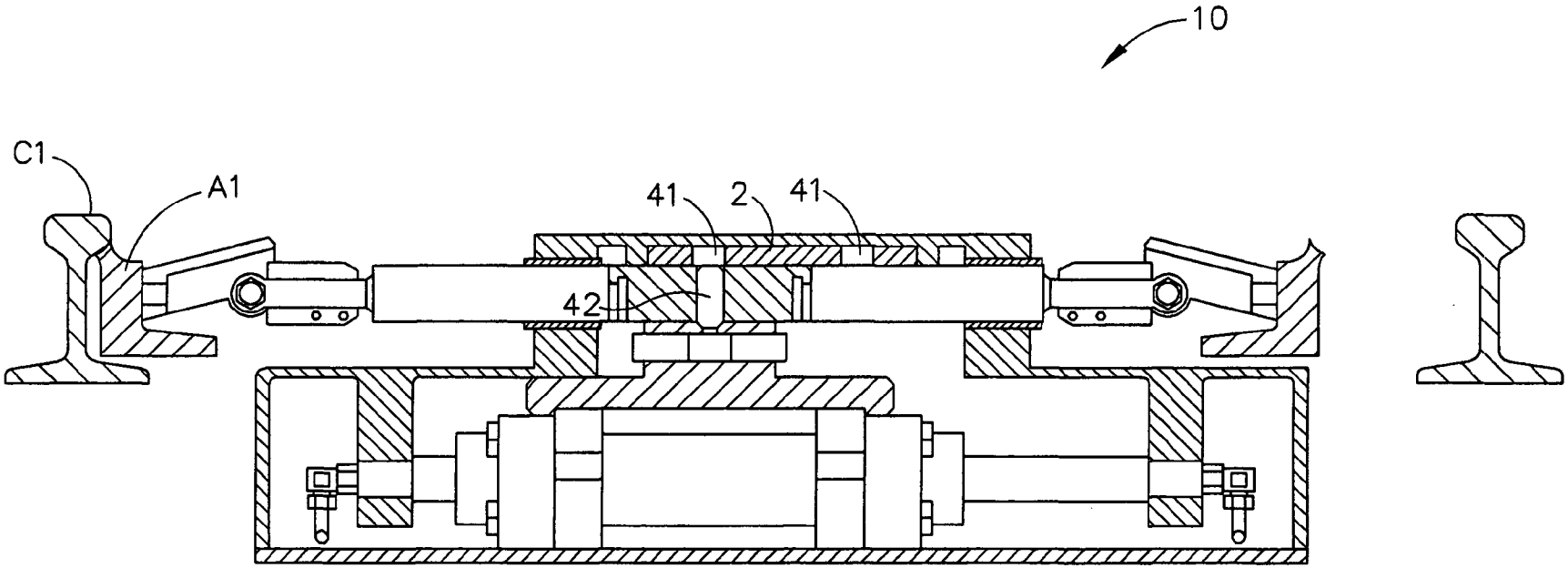

As shown in FIG. 4*d*, this sliding movement of the control rod 4 relative to the plate 2 continues until the left rail end point A1 contacts the left hand stock rail C1. At this point, the upper end of the operating pin 42 aligns with the left hand fixed seat 41 in the fixed plate 2. As the slide 6 continues toward the left, the resistance of the control rod 4 will cause the operating pin 42 to rise out of the moving seat 61 in the slide 6, and the operating pin 42 will be forced upwardly by the upper surface of the slide 6, so that the upper end of the operating pin 42 will enter the left hand fixed seat 41.

Figure 4E:
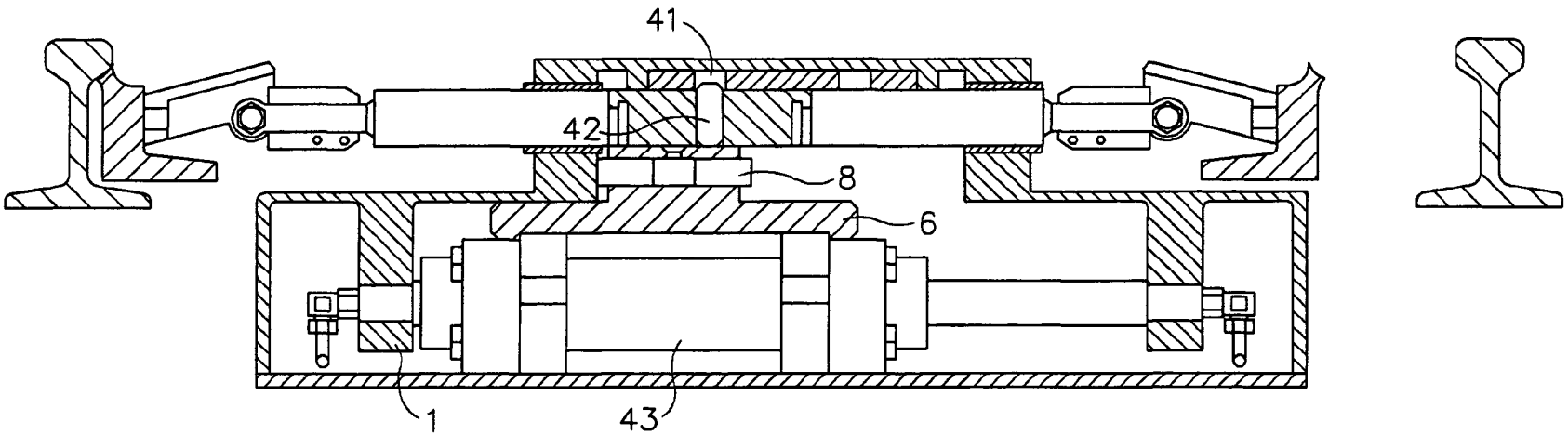

As shown in FIG. 4*e*, with the upper end of the operating pin 42 forced into the left hand fixed seat 41, the control rod 4 is again held in position relative to the fixed plate 2, consequently holding the left rail end point A1 in contact with the left stock rail C1. The slide 6 continues to the left, along with the sliding mechanism 43, until the end of the stroke is reached, where the stroke limiter 8 contacts the casing 1. Movement to the right is accomplished in a fashion similar to movement to the left.

Figure 2:
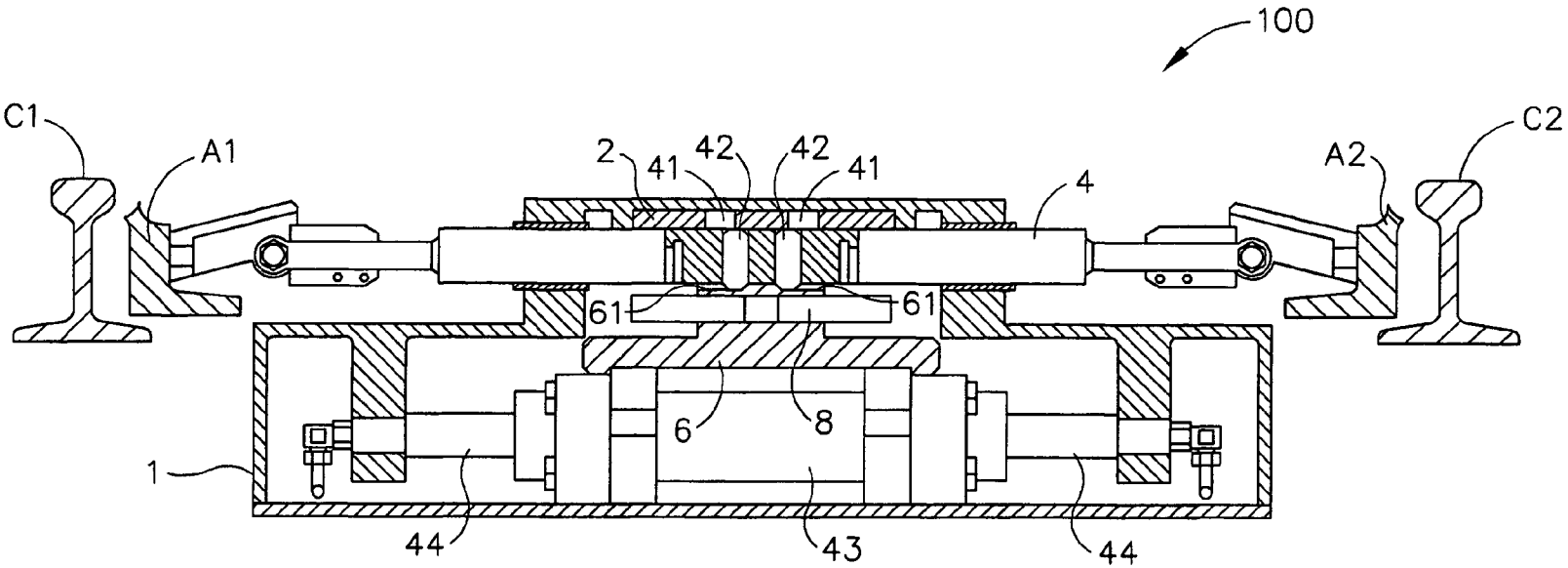
FIG. 2 is a schematic view of a second embodiment of a machine according to the present invention, having two operating pins, for use with split point movements.

A second embodiment 100 of the present invention, shown in FIG. 2, can have two operating pins 42. In this case, the slide 6 has two grooves 61 which are parallel to the axis of the control rod 4. The fixed plate 2 is the same as the one shown in FIG. 1. This embodiment functions similarly to the first embodiment, except that when the slide 6 moves to the left, the left operating pin 42, riding in the left groove 61, is pushed by the slide 6 to move the control rod 4 to the left. When the left rail end point A1 contacts the left stock rail C1, the left operating pin 42 aligns with the left hand fixed seat 41. When this alignment occurs, the resistance in the control rod 4 causes the left operating pin 42 to rise out of the left groove 61, forcing the upper end of the left operating pin 42 into the left hand fixed seat 41 in the fixed plate 2. This locks the control rod 4 in its left hand position.

From this position, movement of the slide 6 to the right allows the left operating pin 42 to fall into the left groove 61, thereby releasing the control rod 4 from the fixed plate 2. Thereafter, as the slide 6 moves to the right, the right operating pin 42 is pushed by the right groove 61 to move the control rod 4 to the right. When the right rail end point A2 contacts the right stock rail C2, the right operating pin 42 aligns with the right hand fixed seat 41. When this alignment occurs, the resistance of the control rod 4 causes the right operating pin 42 to rise out of the right groove 61, forcing the upper end of the right operating pin 42 into the right hand fixed seat 41.

Electrical contacts, or some other sensing device, can be incorporated in the switch machine to detect when the operating pin 42 enters a fixed seat 41, indicating that the control rod 4 is locked in either the left or the right position. Detection of this condition is typically utilized by a control circuit to allow a train to proceed through the switch point, or to allow the movement of some other switching device.

Figure 3:
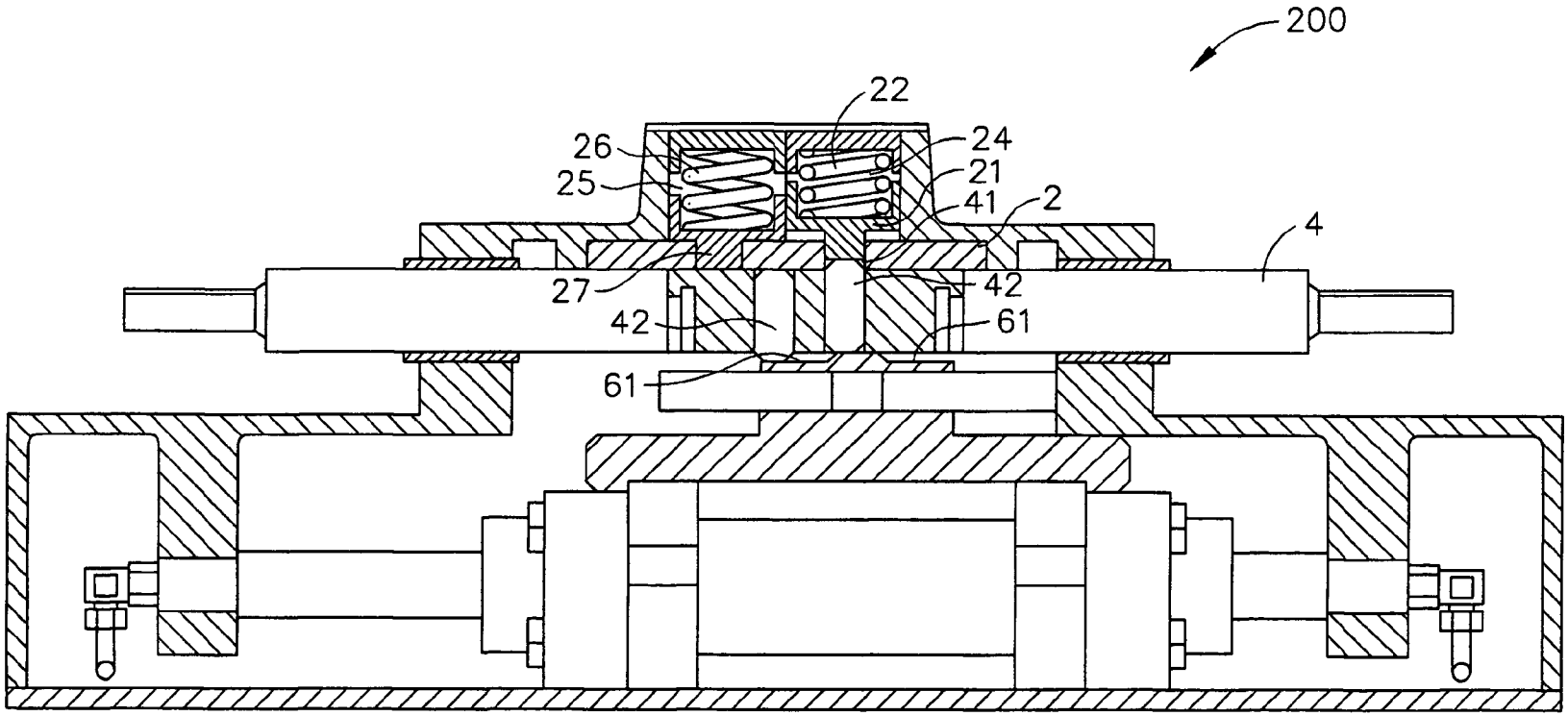
FIG. 3 is a schematic view of a third embodiment of a machine according to the present invention, having two spring loaded operating pins, for use with split point movements.

However, even if the control rod 4 locks in position, an unsafe condition exists if the respective stock rail C1, C2 has somehow become displaced, or is missing. It may be desirable to insure that the locking of the control rod 4 in position is not electrically detected unless the stock rail C1, C2 is also in its expected position, thereby increasing the level of safety. According to a third embodiment 200 of the invention, therefore, the switch point machines of the present invention can be equipped with spring loaded mechanisms to force the operating pins 42 downwardly, as shown in FIG. 3. Specifically, on a machine having two operating pins 42, the upper part of the casing 1 can have two chambers 24, 25 each housing an occlusion plate 21, 27 which is forced downwardly by a biasing device such as a spring 22, 26, thereby occluding the fixed seats 41. In this embodiment, each operating pin 42, in order to enter its respective fixed seat 41 in the fixed plate 2, when pushed upwardly by the slide 6, must overcome the opposing force of the respective spring 22, 26. This allows the control rod 4 to be locked in place only in the presence of the stock rail C1, C2. If the stock rail is not contacted, the control rod 4 will simply continue moving, and the operating pin 42 will remain in its groove 61 on the slide 6. If no resistance is offered by a stock rail, in other words, there is insufficient reactive force transmitted through the control rod 4 to cause the operating pin 42 to rise out of the groove 61 and into the fixed seat 41, against the spring pressure. In this event, the switch point machine will not give an electrical indication of entry of the operating pin 42 into the fixed seat 41, thereby demonstrating that locking of the control rod 4 has not been accomplished.

Figure 5B:
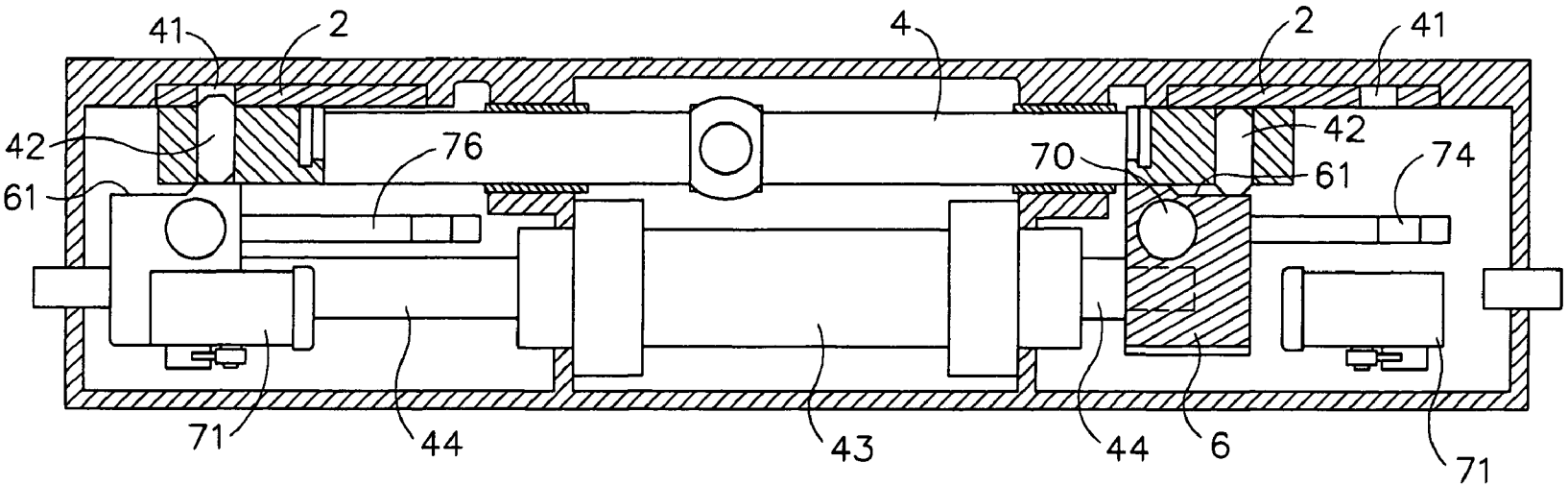
FIG. 5*b* is a horizontal section of the apparatus shown in FIG. 5*a*.

As has been mentioned, the present invention, as described for use in split point movements in a switch point assembly, can also be embodied in a machine 300 for use in "moving point frogs" as illustrated in FIGS. 5*a* and 5*b*. As is known in the art, the moving point of a movable point frog assembly can be a point at which two deflectable rail ends are joined and tapered. The moving point MP can deflect either to the left or the right as desired, so as to contact either the left wing rail B1 or the right wing rail B2. In this embodiment, the housing of the sliding mechanism 43 is fixedly mounted to the casing 1, while the piston rods 44 are free to move in concert to the left and right. The outer end of each piston rod 44 is connected to one of two slides 6. Each slide 6 is in contact with a surface of the control rod 4. The slides 6 are equipped with grooves 61, with each groove 61 being adapted to receive a first end of one of the operating pins 42. The operating pins 42 ride in horizontal bores through the control rod 4. A pair of fixed plates 2 are provided, also in contact with the control rod 4, with each fixed plate 2 having a fixed seat 41 adapted to receive a second end of a respective operating pin 42.

The machine 300 operates in the same manner as the machine 100, except that fluid pressure to the sliding mechanism 43 moves the two piston rods 44 in concert, rather than moving the housing of the sliding mechanism 43. Stroke limiters 50 are provided on either the casing 1 or the piston rods 44 to limit the stroke of the piston rods 44. As the piston rods 44 of the sliding mechanism 43 move, they transmit this motion to the control rod 4 via one or the other of the slides 6, by interaction with one or the other of the operating pins 42, as before. When one of the operating pins 42 reaches its respective fixed seat 41 in the fixed plate 2, the control rod 4 is fixed relative to the plate 2, and the slide 6 is free to move until the end of its stroke, as before. The control rod 4 has a central yoke 48 which connects the control rod 4 to the moving point MP of a movable point frog assembly. The moving point MP is shown in both of its positions, contacting either the left wing rail B1 or the right wing rail B2.

The machine 300 can be equipped with stabilization pistons 70 for the piston rods 44. Each stabilization piston 70 can be spring loaded to force a wheel 72 downwardly onto a fixed plate 76. As the piston rod 44 reaches either end of its stroke, the wheel 72 comes to rest in a depression 74 of the plate 76, to maintain the piston rod 44 in the correct position. A similar stabilization piston could be provided in the other embodiments, to maintain the movable housing of the sliding mechanism 43 in place at either end of its stroke.

The machine 300 can also be equipped with switches 71 that electrically signal the end of the stroke of the piston rods 44, confirming that the movement of the moving point MP of the frog assembly has been correctly executed. The switches 71 shown have a follower element 73 which follows an angled groove 75 in the respective slide 6, such that the movement of the slide 6 moves the follower element 73 to trip the switch 71. Proximity switches, or other types of switches, could also be used. Similar switches could also be used to indicate the position of the movable sliding mechanism 43 at either end of its stroke, in the other embodiments.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A machine for railway switching applications on a railroad bed, comprising:

a casing, said casing being fixedly mounted on said railroad bed relative to all directions;

a control rod adapted for sliding movement between two alternative positions relative to said casing, said control rod being connectable to at least one movable switching element of a railway switching application;

a fixed plate, said fixed plate being fixedly mounted to said casing, said fixed plate having at least one fixed seat, said fixed seat being maintained in a fixed position relative to said casing;

at least one operating pin slidably positioned in said control rod, said operating pin being adapted to selectively enter said at least one fixed seat to lock said control rod in either of said two positions relative to said casing;

a sliding device, said sliding device having a housing;

at least one slide mounted to said sliding device, said at least one slide contacting said control rod;

at least one moving seat on said slide, said at least one moving seat being adapted to receive said at least one operating pin; and at least one operating rod extending from said sliding device, said sliding device being adapted for relative sliding movement between said housing and said operating rod, said sliding device being adapted to actuate movement of said at least one slide by any initiation of said relative sliding movement between said housing and said operating rod, and to selectively engage said operating pin with said at least one moving seat, for movement of said control rod, and to selectively engage said operating pin with said at least one fixed seat, for locking of said control rod.

2. The machine recited in claim 1, further comprising:
at least one chamber on said casing;
an occlusion plate in said at least one chamber, said plate being adapted to occlude said at least one fixed seat on said fixed plate, thereby resisting entry of said operating pin into said at least one fixed seat.

3. The machine recited in claim 1, wherein:
said at least one slide is mounted to said housing of said sliding device; and
said at least one operating rod is fixedly attached to said casing, relative to the direction of said relative sliding movement between said housing and said operating rod, such that said sliding device housing moves relative to said casing.

4. The machine recited in claim 1, wherein:
said at least one slide is mounted to said at least one operating rod of said sliding device; and
said housing is fixedly attached to said casing, relative to the direction of said relative sliding movement between said housing and said operating rod, such that said at least one operating rod moves relative to said casing.

5. The machine recited in claim 1, further comprising a stroke limiter positioned at the end of the stroke of said slide, to limit said stroke of said slide relative to said casing.

6. The machine recited in claim 5, wherein said stroke limiter is mounted to said slide.

7. The machine recited in claim 5, wherein said stroke limiter is mounted to said casing.

8. The machine recited in claim 1, further comprising a power unit adapted to generate said relative sliding movement between said housing and said operating rod of said sliding device.

9. The machine recited in claim 8, wherein said power unit is internal to said casing.

10. The machine recited in claim 8, wherein said power unit is external to said casing.

11. The machine recited in claim 8, wherein:
said sliding device housing includes a cylinder;
said operating rod comprises a piston rod; and
said power unit comprises a fluid pressure supply.

12. The machine recited in claim 1, wherein:
said at least one slide has two of said moving seats; and
said control rod has two of said operating pins.

13. The machine recited in claim 2, further comprising a spring in said at least one chamber, said spring being adapted to bias said occlusion plate to occlude said fixed seat.

14. A machine for railway switching applications, comprising:
a fixed casing;
a control rod adapted for sliding movement between two alternative positions relative to said casing, said control rod being connectable to at least one movable switching element of a railway switching application;
a fixed plate mounted to said casing, said fixed plate having at least one fixed seat;
at least one operating pin slidably positioned in said control rod, said operating pin being adapted to selectively enter said at least one fixed seat to lock said control rod in either of said two positions relative to said casing;
a sliding device, said sliding device having a housing;
at least one slide mounted to said sliding device, said at least one slide contacting said control rod;
at least one moving seat on said slide, said at least one moving seat being adapted to receive said at least one operating pin;
at least one operating rod extending from said housing of said sliding device, said sliding device being adapted for relative sliding movement between said housing and said operating rod to thereby move said at least one slide and selectively engage said, operating pin with one of said at least one moving seat, for movement of said control rod, and said at least one fixed seat, for locking of said control rod; and
at least one stabilization piston mounted on said sliding device, said stabilization piston being adapted to selectively stabilize a desired relative configuration of said at least one operating rod and said housing of said sliding device.

15. The machine recited in claim 14, wherein said at least one stabilization piston is mounted to said at least one operating rod of said sliding device.

16. A machine for selective movement of the movable V-point of a railway moving point frog assembly on a railroad bed comprising:
a fixed casing, said fixed casing being fixedly mounted on said railroad bed relative to all directions, said fixed cams being adapted to function as a railroad tie beneath the rails of intersecting sections of railroad tracks and the moving point frog assembly between them;
a control rod mounted within said fixed casing, said control rod being adapted for sliding movement between two alternative positions relative to said fixed casing, said control rod being connectable to a movable V-point of a railway moving point frog assembly located above said fixed casing;
a fixed plate, said fixed plate being fixedly mounted to said casing, said fixed plate having at least one fixed seat, said fixed seat being maintained in a fixed position relative to said fixed casing;
at least one operating pin slidably positioned in said control rod, said operating pin being adapted to selectively enter said at least one fixed seat to lock said control rod in either of said two positions relative to said casing;
a sliding device, said sliding device having a housing;
at least one slide mounted to said sliding device, said at least one slide contacting said control rod;
at least one moving seat on said slide, said at least one moving seat being adapted to receive said at least one operating pin; and
at least one operating rod extending from said housing of said sliding device, said sliding device being adapted for relative sliding movement between said housing and said operating rod, said sliding device being adapted to actuate movement of said at least one slide by any initiation of said relative sliding movement between said housing and said operating rod, and to selectively engage said operating pin with said at least one moving seat, for movement of said control rod, and to selectively engage said operating pin with said at least one fixed seat, for locking of said control rod.

17. The machine recited in claim 16, further comprising a power unit adapted to generate said relative sliding movement between said housing and said operating rod of said sliding device.

18. The machine recited in claim 17, wherein said power unit is internal to said casing.

19. The machine recited in claim 17, wherein:
said sliding device housing includes a cylinder;
said operating rod comprises a piston rod; and
said power unit comprises a fluid pressure supply.

* * * * *